US005492446A

United States Patent [19]

Hawkins et al.

[11] Patent Number: 5,492,446

[45] Date of Patent: Feb. 20, 1996

[54] SELF-ALIGNING VARIABLE STATOR VANE

[75] Inventors: James T. Hawkins, Cincinnati; Ritchie D. Price, Fairfield; George A. Oxenham, Morrow, all of Ohio

[73] Assignee: General Electric Company, Cincinnati, Ohio

[21] Appl. No.: 356,763

[22] Filed: Dec. 15, 1994

[51] Int. Cl.[6] ..... F01D 17/16

[52] U.S. Cl. ..... 415/160; 411/116; 411/424

[58] Field of Search ..... 415/160; 411/116, 411/117, 417, 418, 424, 974

[56] References Cited

U.S. PATENT DOCUMENTS

| | | | |
|---|---|---|---|
| 1,967,145 | 7/1934 | Fisher | 411/417 |
| 1,987,474 | 1/1935 | Grant | 411/417 |
| 2,278,790 | 4/1942 | Langmaid | 411/116 |
| 2,730,154 | 1/1956 | Aspey | 411/418 |
| 2,930,579 | 3/1960 | Boyd et al. . | |
| 3,314,595 | 4/1967 | Burge et al. | 415/160 |
| 4,498,790 | 2/1985 | Fisher | 384/428 |
| 4,514,141 | 4/1985 | Marey | 415/160 |
| 4,585,390 | 4/1986 | Pirtle et al. | 415/160 |
| 4,979,874 | 12/1990 | Myers | 415/160 |
| 5,000,659 | 3/1991 | Catte et al. | 415/150 |
| 5,277,544 | 1/1994 | Naudet | 415/160 |

*Primary Examiner*—Edward K. Look
*Assistant Examiner*—Michael S. Lee
*Attorney, Agent, or Firm*—Andrew C. Hess; Patrick R. Scanlon

[57] ABSTRACT

A variable stator vane includes an airfoil with an integral outer trunnion having a seat extending integrally therefrom. A threaded stem extends from the seat and includes a coextensive alignment surface that cooperates with a complementary mounting hole in a lever arm which restrains rotation of the lever arm about the stem during assembly for ensuring a predetermined rotational orientation between the lever arm and the airfoil.

11 Claims, 3 Drawing Sheets

SELF-ALIGNING VARIABLE STATOR VANE

The Government has rights in this invention pursuant to Contract No. F33657-88-C-2133.

The present invention relates generally to gas turbine engines, and, more specifically, to compressor variable stator vanes therein.

BACKGROUND OF THE INVENTION

A typical gas turbine engine compressor includes several rows or stages of compressor stator vanes and corresponding rows or stages of compressor rotor blades therebetween. As ambient air flows through each succeeding compressor stage during operation, it is successively compressed for providing compressed air to a combustor located downstream therefrom wherein it is mixed with fuel and ignited for generating hot combustion gases which power the engine.

In order to improve the overall operation of the compressor, several compressor stator vanes are variable for allowing each vane to rotate around its longitudinal or radial axis to adjust the angular orientation of the vane relative to the airflow thereover. Variable stator vanes include an integral outer trunnion disposed in a complementary mounting boss in a stator casing for allowing angular adjustment of the vane relative to the airflow thereover. Extending outwardly from the vane trunnion in one exemplary embodiment is a coaxial threaded stem around which is seated and fixedly joined thereto by a retention nut a lever arm having a distal end pivotally joined to an actuation ring. All of the vane lever arms in a single row are joined to a common actuation ring for ensuring that all of the variable vanes are positioned relative to the airflow in the compressor stage at the same angular orientation. If the orientation of one or more vanes is different than the remainder of the vanes in the same stage, an aerodynamic distortion may be generated which corresponds to a one excitation per revolution of the downstream stage or rotor blades which may decrease the useful life thereof.

In order to accurately assemble the lever arms to the respective vane trunnions during initial assembly, or during field maintenance of the compressor, each trunnion typically includes a generally D-shaped seat at the juncture of the base of the stem and the top of the trunnion, with the proximal end of each lever arm having a corresponding D-shaped mounting hole. The mounting hole is typically slightly less in width than the width of the trunnion seat so that tightening of the nut on the stem forces the lever arm into a no tolerance or interference fit on the trunnion seat. In order to allow assembly of the mounting hole over the trunnion stem, the mounting hole typically includes opposing arcuate cutouts representing portions of a circle having a diameter slightly larger than the diameter of the trunnion stem. However, this allows the lever arm to be assembled downwardly over the stem without interference therewith, and correspondingly allows the lever arm to be misaligned with the trunnion seat unless suitable care is exercised for ensuring accurate alignment therebetween.

Although the corresponding D-shapes of the trunnion seat and lever arm mounting hole are provided for eliminating misalignment therebetween, the assembly process for obtaining the interference fit therebetween may nevertheless result in a misalignment when the interference fit is formed. Tightening the retention nut without confirming that the lever is oriented correctly with the vane stem flats can produce misalignments of any angle between the lever arm and its respective vane. This is possible since the force created by applying torque to the nut has the capability to produce plastic deformation in the parent metal of both the trunnion seat and the lever arm. Since this interface is covered by the retention nut, this occasional misalignment can go unnoticed during assembly.

SUMMARY OF THE INVENTION

A variable stator vane includes an airfoil with an integral outer trunnion having a seat extending integrally therefrom. A threaded stem extends from the seat and includes a coextensive alignment surface that cooperates with a complementary mounting hole in a lever arm which restrains rotation of the lever arm about the stem during assembly for ensuring a predetermined rotational orientation between the lever arm and the airfoil.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
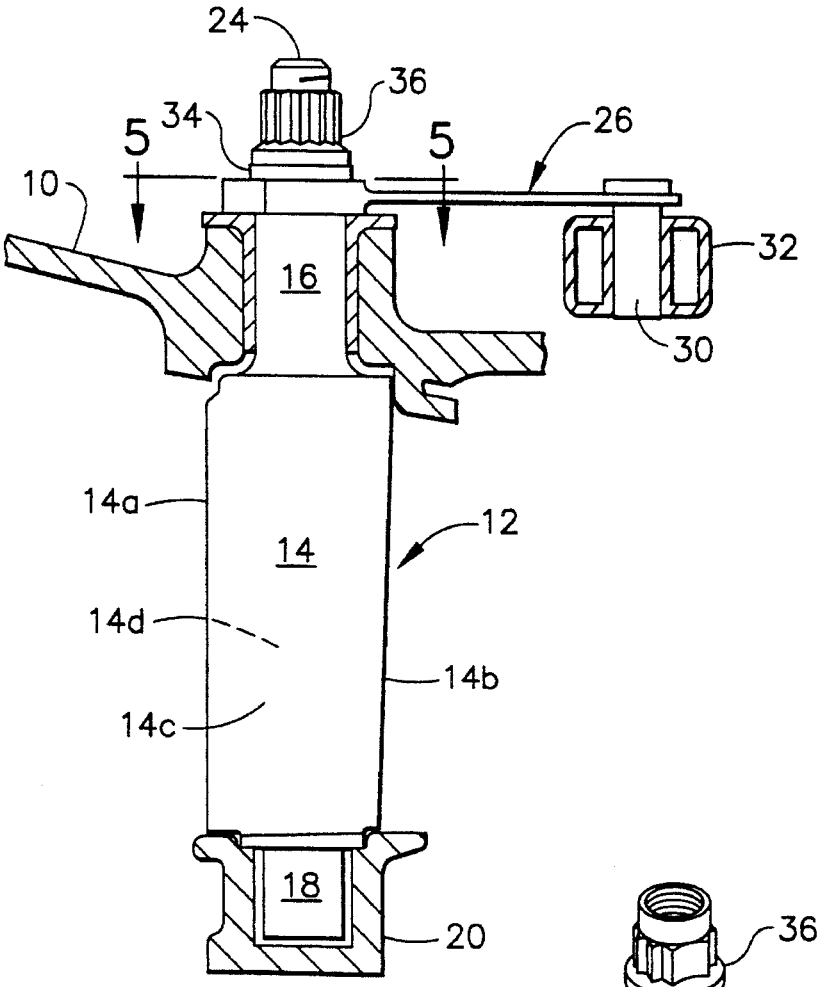
FIG. 1 is a radial or elevational view of an exemplary compressor variable stator vane mounted in an annular casing and having a lever arm joined to an actuation ring.

Illustrated in FIG. 1 is a portion of an annular casing 10 of an exemplary gas turbine engine compressor to which is mounted a plurality of circumferentially spaced apart compressor variable stator vanes 12. Each vane 12 includes a conventional airfoil 14 having a leading edge 14*a*, a downstream trailing edge 14*b*, and pressure and suction sides 14*c* and 14*d* extending therebetween.

The vane 12 further includes a radially outer trunnion 16 extending coaxially and integrally outwardly from the top of the airfoil 14 for pivotally mounting the airfoil 14 in a corresponding bushing in the outer casing 10 in a conventionally known manner. In the exemplary embodiment illustrated in FIG. 1, the vane 12 also includes a radially inner trunnion 18 mounted in a sealing ring 20, although in other embodiments the inner trunnion 18 and ring 20 may not be used.

Figure 2:
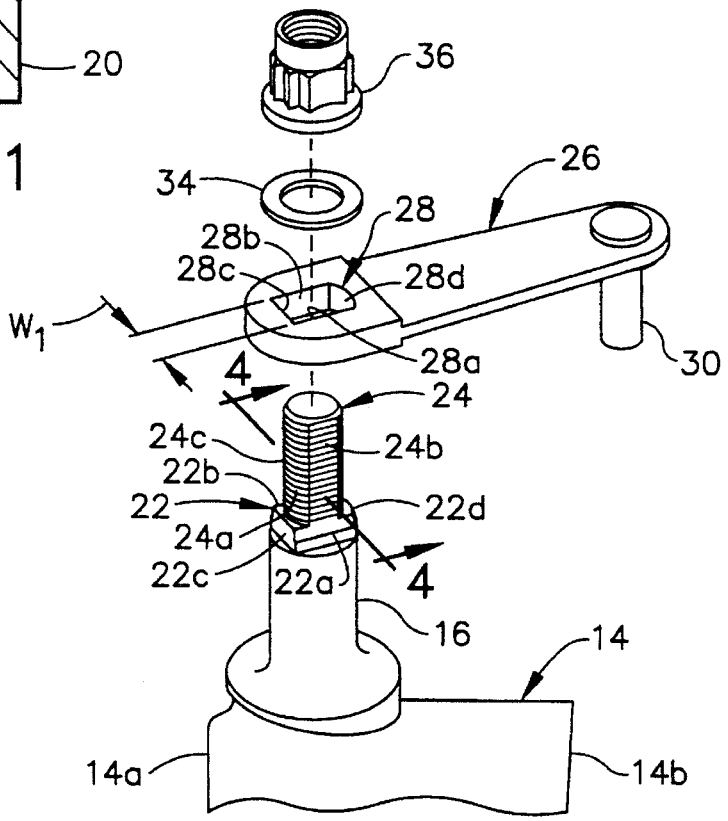
FIG. 2 is an exploded view of the stator vane illustrated in FIG. 1 showing the lever arm mounted to an outer trunnion of the stator vane in accordance with one embodiment of the present invention.

The variable stator vane 12 is illustrated in more particularity in FIG. 2 and further includes a quadrilateral or generally D-shaped head or seat 22 extending integrally outwardly from an outer distal end of the outer trunnion 16 and coaxially therewith. The seat 22 includes a pair of opposite, parallel seating flats 22*a* and 22*b*, a flat base or side 22*c* extending between the flats 22*a,b* at one end thereof, and an arcuate side 22*d* extending therebetween at an opposite end thereof which collectively define the generally D-shaped configuration thereof.

Extending integrally outwardly from the trunnion seat 22 and coaxially with the trunnion 16 is a mounting stem 24 having conventional screw threads 24*a* spiraling therearound.

A lever arm 26 includes a mounting hole 28 at a proximal end thereof which is positionable over the vane stem 24 for being seated on the trunnion seat 22 for mounting the lever arm 26 thereon. An actuation pin 30 is disposed at the distal end of the lever arm 26 and is received in a complementary hole in an annular actuation ring 32 which is shown in FIG. 1. The mounting hole 28 is complementary with the trunnion seat 22 and is also a quadrilateral, generally D-shaped hole having a pair of opposite and parallel hole flats 28*a* and 28*b*, a flat base or side 28*c* extending between the hole flats 28*a,b* at one end, and an arcuate side 28*d* extending therebetween at an opposite end.

Figure 4:
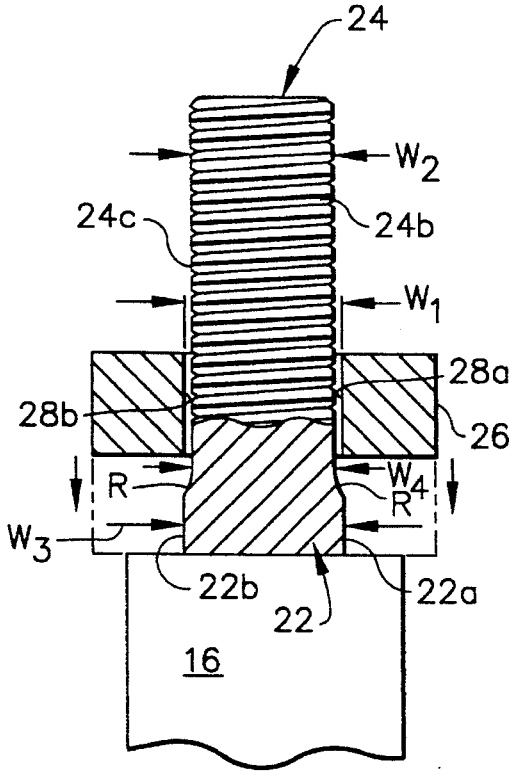
FIG. 4 is a transverse, partly sectional view of the lever arm illustrated in FIG. 2 being installed over the trunnion seat, and taken along line 4—4.
Figure 5:
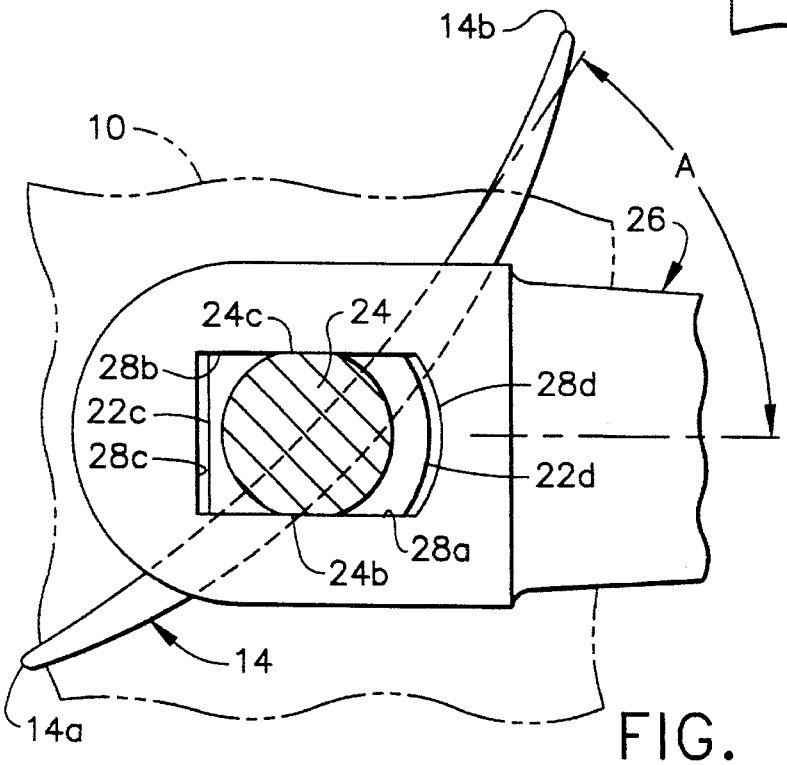
FIG. 5 is a top, partly sectional view of the lever arm shown in FIG. 1 installed over the trunnion seat at a predetermined angular orientation relative to the vane airfoil, and taken along line 5—5.

The mounting hole 28 is sized to have a width slightly less than the width of the trunnion seat 22 for effecting an interference fit therewith when assembled thereto as described in more particularity below. However, to ensure self-alignment between the lever arm 26 and the airfoil 14 during the assembly thereof, the threaded stem 24 includes at least one, and preferably two elongate and coextensive first alignment surfaces which are substantially flat and define opposite stem flats 24*b* and 24*c*. The mounting hole 28 is predeterminedly sized for being installed downwardly over the stem 24 as illustrated in FIGS. 2 and 4 while the stem flats 24*b, c* restrain rotation of the lever arm 26 about the stem 24 until the mounting hole 28 engages the seat 22 for ensuring a predetermined rotational orientation, or reference angle A as illustrated in FIG. 5, between the lever arm 26 and the airfoil 14. In this way, the stem flats 24*b,c* provide self-alignment of the lever arm 26 as it is installed downwardly over the stem 24 relative to the airfoil 14. A conventional washer 34 and retention nut 36 as shown in FIGS. 1 and 2 are installed in turn over the distal end of the stem 24, with the nut 36 being suitably tightened by a wrench for compressing the lever arm mounting hole 28 in an interference fit over the trunnion seat 22.

As shown in more particularity in FIG. 5, the mounting hole flats 28*a,b* define a pair of second alignment surfaces on the lever arm 26 which are complementary with cooperating ones of the stem flats 24*b,c*, or the first alignment surfaces, which restrain rotation of the lever arm 26 about the stem 24 upon installation thereover. In the exemplary embodiment illustrated in FIGS. 1–5, the second alignment surfaces in the form of the hole flats 28*a,b* are integral or one-piece portions of the lever arm mounting hole 28 itself and extend completely therethrough.

Figure 3:
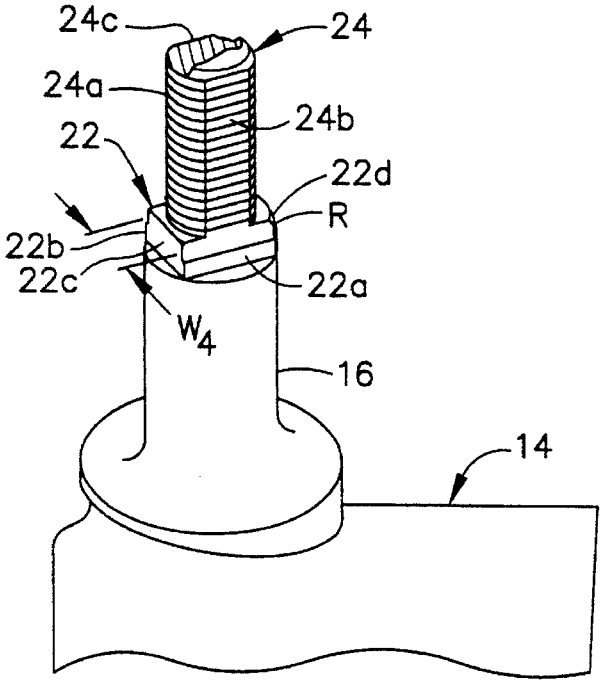
FIG. 3 is an enlarged, perspective view of the outer trunnion illustrated in FIG. 2 including an integral seat and stem configured for self-aligning the lever arm thereover during assembly in accordance with an exemplary embodiment of the present invention.

As shown in FIGS. 3 and 4, the stem flats 24*b,c* extend along the stem 24 coextensively with at least a top portion of respective ones of the seat flats 22*a,b* without an interference fit therewith. In other words, the top portions of the seat flats 22*a,b* as illustrated in FIGS. 3 and 4 define a narrower width relief, designated R, so that the mounting hole 28 may be initially accurately aligned on the seat 22 without interference therewith, with the interference fit then being effected solely along the bottom portion of the seat flats 22*a,b*. As shown in FIG. 5, suitable clearances are preferred between the respective seat flat side 22*c* and mounting hole flat side 28*c*, and between the seat arcuate side 22*d* and the hole arcuate side 28*d* so that an interference fit therebetween is not provided in a manner similar to that found in conventional practice.

As shown in FIG. 4, the mounting hole 28 has a first width $W_1$ measured between the hole flats 28*a,b*. The stem 24 has a second width $W_2$ measured between the stem flats 24*b,c*, with the second width $W_2$ being suitably less than the first width $W_1$ for allowing longitudinal downward translation therebetween without significant rotation during the assembly process. The seat 22 has a third width $W_3$ measured between the seat flats 22*a,b* which is suitably greater than each of the first and second widths $W_1$ and $W_2$ for providing an interference fit between the mounting hole 28 and the seat 22 upon complete seating thereon in abutting contact with the top or distal end of the trunnion 16. The reliefs R at the outer portions of the seat flats 22*a,b* have a fourth width $W_4$ which is narrower than the third width $W_3$, with the reliefs R being preferably coextensive or coplanar with respective ones of the stem flats 24*b,c* for allowing positive initial rotational orientation between the mounting hole 28 and the seat 22 prior to compressive seating therebetween to establish the interference fit as described above.

As shown in FIGS. 3, the screw threads 24*a* on the stem 24 are interrupted in their common outer diameter at the stem flats 24*b,c* and extend only partially therein. The second width $W_2$ between the stem flats 24*b,c* as shown in FIG. 4 is selected to be between the nominal outer diameter and inner diameter of the threads 24*a* formed on the stem 24 as shown in FIG. 3. In this way, the stem flats 24*b,c* not only provide self-alignment between the lever arm 26 and the airfoil 14, but also allow accurate threading engagement of the nut 36 around the full perimeter of the stem 24 without encountering cross-threading. Since the stem flats 24*b,c* as shown in FIG. 3 extend coextensively in common planes with the seat reliefs R, the lever arm 26 is readily installed downwardly thereover while maintaining accurate alignment with the seat 22 prior to being press fit in interference therewith.

Accordingly, the introduction of relatively simple stem flats 24*b,c* and reliefs R on the seat flats 22*a,b* provide an effective self-alignment feature with the complementary mounting hole 28 of the lever arm 26. Other related embodiments are also feasible such as the alternate embodiment illustrated in FIG. 6. In this embodiment, the seat 22 and the stem 24 and their respective flats are identical to those illustrated in the FIG. 3 embodiment. However, the lever arm 26 takes a conventional form having a conventional mounting hole 28A having a generally D-shape but with opposing arcuate cutouts defined by a diameter larger than the diameter of the stem 24 which will allow the lever arm 26 to rotate about the stem 24 without any self-alignment restraint therebetween in a conventionally known manner. However, in order to provide self-alignment between the lever arm 26 and the airfoil 14, a specifically configured alignment washer 38 is fixedly joined by conventional brazing using a complementary brazing alloy shim 40 for joining the washer 38 in alignment with the mounting hole 28A. The hole in the washer 38 is identically configured to the hole 28 described above, with the second alignment surfaces being the opposing hole flats 28*a,b* defined by opposing sides of the hole in the washer 38. The washer 38 fixedly joined to the lever arm 26 then ensures accurate self-alignment between the lever arm 26 and the airfoil 14 as the washer 38 is translated downwardly over the cooperating stem 24. The mounting hole 28A may then be press fit into an interference fit with the seat 22, while the washer 38 maintains accurate alignment.

Figure 7:
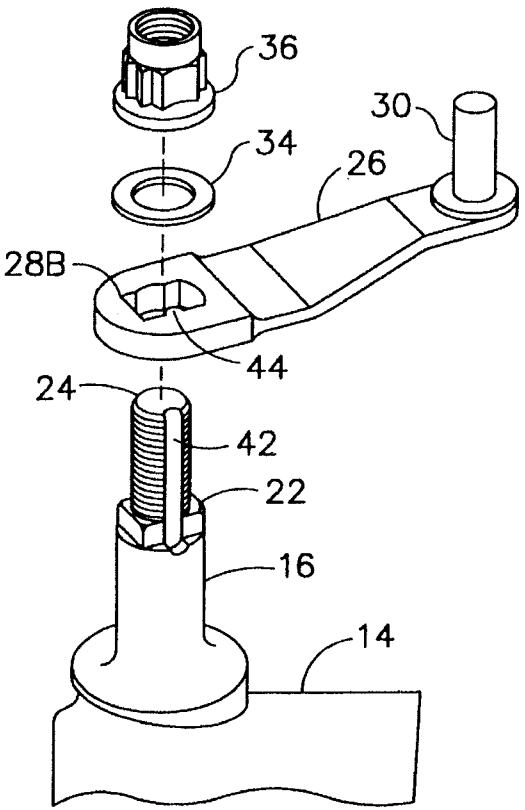
FIG. 7 is an exploded view of a lever arm mounted to a vane trunnion in accordance with another embodiment of the present invention including a cooperating rib and groove for maintaining angular alignment between the lever arm and the vane airfoil.

Illustrated in FIG. 7 is yet another embodiment of the present invention wherein the first alignment surface on the stem 24 is in the form of an elongate groove 42 disposed in only one side thereof and having a generally concave transverse section. The cooperating second alignment surface of the mounting hole, designated 28B, of the lever arm 26 is an integral, elongate rib 44 which is convex in transverse section and complementary with the stem groove 42. The mounting hole 28B is otherwise conventional except for the rib 44 which extends therethrough and which slides downwardly in the stem groove 42 for maintaining self-alignment between the lever arm 26 and the airfoil 14 during assembly. The mounting hole 28*b* is conventionally sized sufficiently smaller than the trunnion seat 22 for being pressed into an interference fit therewith. Alternatively, two opposite grooves 42 could also be used for mating with a respective pair of ribs 44.

Figure 8:
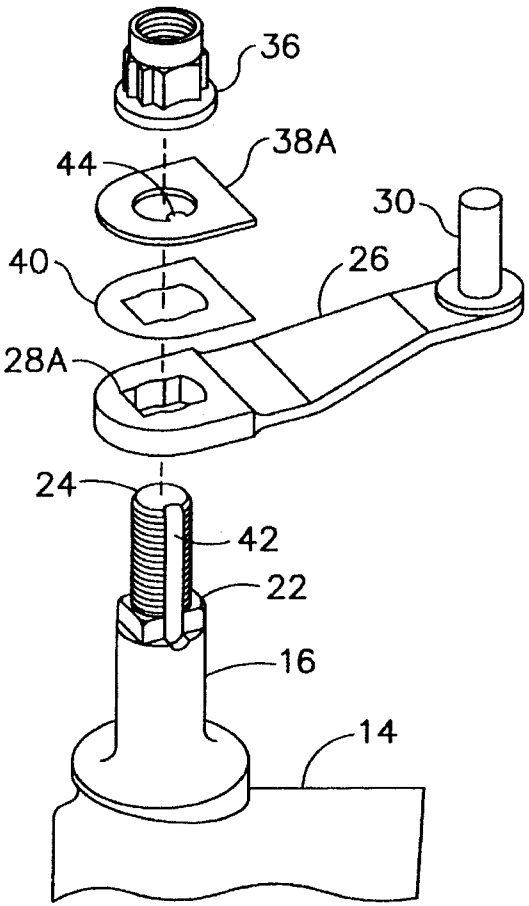
FIG. 8 is an exploded view of a lever arm and vane trunnion in accordance with another embodiment of the present invention including an alignment washer fixedly joined to the lever arm and containing the rib for cooperating with the groove in the trunnion stem.
Figure 6:
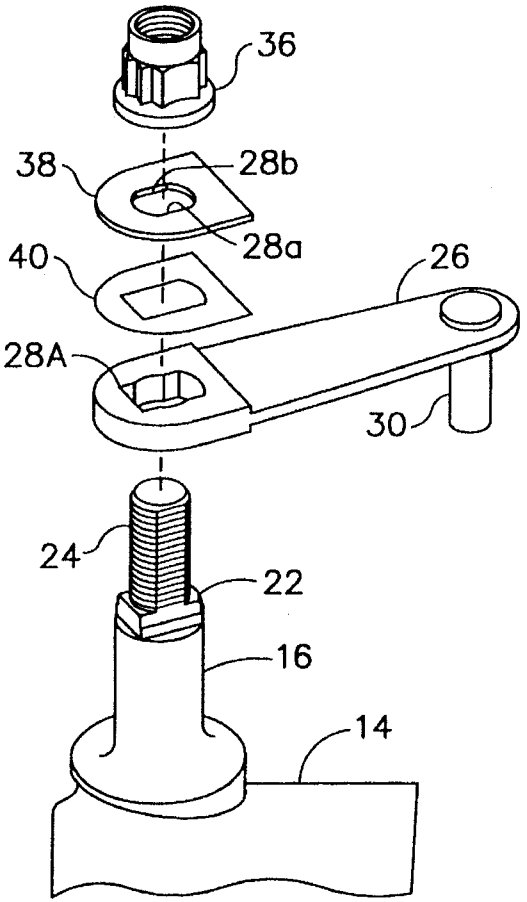
FIG. 6 is an exploded view of a lever arm mounted to a vane trunnion in accordance with another embodiment of the present invention including an alignment washer fixedly joined to the lever arm.

Illustrated in FIG. 8 is yet another embodiment of the present invention which uses selected features from the FIG. 6 and FIG. 7 embodiments. The stem 24 and groove 42 are identical to the FIG. 7 embodiment. The mounting hole 28A is identical to the conventional mounting hole 28A in the FIG. 6 embodiment. However, the washer 38 of the FIG. 6 embodiment is modified to form the washer designated 38A in the FIG. 8 embodiment which itself includes the rib 44 thereon. The washer 38A is fixedly joined around the mounting hole 28A by being conventionally brazed thereto using a brazing shim 40 as the brazing material.

The several exemplary embodiments described above require different manufacturing procedures with different manufacturing costs associated therewith, but may be used wherever desired. The embodiment illustrated in FIGS. 1–5 is preferred in view of its relative simplicity and effectiveness for ensuring self-alignment between the lever arm 26 and the airfoil 14 while still obtaining an effective interference, no-tolerance fit therebetween.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A variable stator vane comprising:

an airfoil having an integral outer trunnion for pivotally mounting said airfoil to a stator casing;

a seat extending integrally from a distal end of said trunnion, and having a pair of opposite, parallel flats;

a threaded stem extending integrally from said trunnion seat and coaxial with said trunnion, said stem having at least one coextensive first alignment surface; and a lever arm having a mounting hole at a proximal end thereof being complementary with said trunnion seat, said mounting hole being sized for being installed downwardly over said stem while said first alignment surface restrains rotation of said lever arm about said stem until said mounting hole engages said seat for ensuring a predetermined rotational orientation between said lever arm and said airfoil.

2. A variable stator vane according to claim 1 wherein said mounting hole includes a second alignment surface being complementary with said first alignment surface for restraining rotation of said lever arm about said stem upon installation thereover.

3. A variable stator vane according to claim 2 further comprising a washer fixedly joined to said lever arm around said mounting hole, and said second alignment surface is defined by a side of said washer.

4. A variable stator vane according to claim 2 wherein:

said first alignment surface is elongate and concave in transverse section; and said second alignment surface is elongate and convex in transverse section.

5. A variable stator vane according to claim 2 wherein said second alignment surface is an integral portion of said lever arm mounting hole and extends therethrough.

6. A variable stator vane according to claim 5 wherein:

said first alignment surface is substantially flat and defines a stem flat extending along said stem coextensively with at least a portion of a respective one of said seat flats; and said second alignment surface is substantially flat and defines a hole flat.

7. A variable stator vane according to claim 6 further comprising a pair of said stem flats on opposite sides of said stem and parallel to each other, and a corresponding pair of said hole flats in said lever arm mounting hole.

8. A variable stator vane according to claim 7 wherein screw threads on said stem are interrupted at said stem flats and extend only partially therein.

9. A variable stator vane according to claim 7 wherein:

said mounting hole has a first width between said hole flats;

said stem has a second width between said stem flats, with said second width being less than said first width for allowing longitudinal translation between said mounting hole and said stem; and said seat has a third width between said seat flats, with said third width being greater than said first and second widths for providing an interference fit between said mounting hole and said seat upon seating thereon in abutting contact with said trunnion.

10. A variable stator vane according to claim 9 wherein said seat flats include a respective pair of flat reliefs at an outer portion of said seat having a fourth width being narrower than said third width, and being coextensive with respective ones of said stem flats for allowing positive initial rotational orientation between said mounting hole and said seat prior to compressive seating therebetween to establish said interference fit.

11. A variable stator vane according to claim 10 wherein said seat is generally D-shaped and defined by said opposite seat flats, a flat side extending between said seat flats at one end, and an arcuate side extending therebetween at an opposite end.

* * * * *